US009571947B2

(12) United States Patent
Jinton et al.

(10) Patent No.: US 9,571,947 B2
(45) **Date of Patent: *Feb. 14, 2017**

(54) HEARING AID INTERCONNECTION SYSTEM

(71) Applicant: Oticon Medical A/S, Smørum (DK)

(72) Inventors: Lars Jinton, Mölndal (SE); Magdalena Eriksson, Smørum (DK); Thomas Eriksson, Smørum (DK)

(73) Assignee: OTICON MEDICAL A/S, Smorum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/965,438

(22) Filed: Dec. 10, 2015

(65) Prior Publication Data

US 2016/0100264 A1 Apr. 7, 2016

Related U.S. Application Data

(63) Continuation of application No. 14/550,238, filed on Nov. 21, 2014, now Pat. No. 9,241,225.

(30) Foreign Application Priority Data

Nov. 25, 2013 (EP) ..... 13194281

(51) Int. Cl.
*H04R 25/00* (2006.01)

(52) U.S. Cl.
CPC ..... *H04R 25/606* (2013.01); *H04R 25/556* (2013.01); *H04R 2460/13* (2013.01)

(58) Field of Classification Search
CPC .. H04R 25/606; H04R 25/556; H04R 2460/13
USPC ..... 381/326
See application file for complete search history.

(56) References Cited

U.S. PATENT DOCUMENTS

| | | | | |
|---|---|---|---|---|
| 5,935,170 | A | 8/1999 | Hakansson | |
| 7,376,237 | B2 | 5/2008 | Westerkull | |
| 7,619,498 | B2 | 11/2009 | Miura | |
| 8,139,800 | B2 | 3/2012 | Ho | |
| 8,406,443 | B2 | 3/2013 | Westerkull et al. | |
| 2006/0045298 | A1 | 3/2006 | Westerkull | |
| 2007/0182257 | A1 | 8/2007 | Miura et al. | |
| 2009/0023109 | A1* | 1/2009 | Jinton | A61C 8/0025 433/174 |
| 2009/0192345 | A1* | 7/2009 | Westerkull | H04R 25/606 600/25 |
| 2010/0137675 | A1 | 6/2010 | Parker | |
| 2010/0209873 | A1* | 8/2010 | Asnes | H04R 25/606 433/174 |

(Continued)

*Primary Examiner* — Tuan D Nguyen
(74) *Attorney, Agent, or Firm* — Birch, Stewart, Kolasch & Birch, LLP

(57) ABSTRACT

According to an embodiment, a hearing aid system is disclosed. The system includes an abutment, an extension member and a hearing aid device. The abutment is configured to mechanically attach into a skull bone of a hearing aid user. The extension member is configured to attach to the abutment and further comprising a hearing aid coupling surface adapted to attach with a hearing aid device. The hearing aid device includes a coupling adapted to mechanically attach to the hearing aid coupling surface. The extension member is configured to attach between the abutment and the coupling and to extend length between the abutment and the hearing aid coupling.

15 Claims, 8 Drawing Sheets

(56) References Cited

U.S. PATENT DOCUMENTS

| | | | | |
|---|---|---|---|---|
| 2010/0292529 | A1* | 11/2010 | Westerkull ..... | H04R 25/606<br>600/25 |
| 2012/0172658 | A1 | 7/2012 | Bjorn et al. | |
| 2013/0041206 | A1 | 2/2013 | Andersson | |
| 2013/0090518 | A1 | 4/2013 | Björn et al. | |
| 2014/0179985 | A1 | 6/2014 | Andersson | |
| 2014/0270293 | A1 | 9/2014 | Ruppersberg | |
| 2015/0117689 | A1 | 4/2015 | Bergs | |

* cited by examiner

HEARING AID INTERCONNECTION SYSTEM

This application is a Continuation of co-pending application Ser. No. 14/550,238, filed on Nov. 21, 2014, and for which priority is claimed under 35 U.S.C. §120. This application claims priority of Application No. EP 13194281.5, filed in Europe on Nov. 25, 2013, under 35 U.S.C. §119; all of which are hereby expressly incorporated by reference into the present application.

FIELD

The present disclosure generally relates to a hearing aid interconnection system between a bone anchored fixture and a skin penetrating hearing aid abutment. The present disclosure more particularly relates to a hearing aid interconnection system including an extension device for an abutment.

BACKGROUND

Hearing impairment is a very common physical disability. One reason for poor hearing is reduced function in the inner ear. Age-related hearing loss is an example of reduced function of the inner ear.

Another reason for poor hearing is when the sound cannot reach the nerve cells of the inner ear. This is the case if a patient was born without external ear canals. In this case a conventional hearing aid with a mould in the ear canal opening is not a solution, however; if the inner ear is normal, sound conducted via the skull bone may give close to normal hearing. Accordingly, a bone-anchored hearing aid is primarily suited to people having conductive hearing losses, unilateral hearing losses and people with hearing losses who cannot wear in-the ear (ITE) or behind-the-ear (BTE) hearing aids.

Bone anchored hearing aids are vital for the rehabilitation of patients suffering from hearing losses for which traditional hearing aids are insufficient. A typical bone anchored hearing aid consists of an external hearing aid with a vibrating transducer that is connected to a skin-penetrating abutment through a coupling. The abutment may have an interconnection to a screw-shaped fixture anchored in the skull bone. Such fixture can be made of titanium and may be provided with a flange in order to prevent the fixture from being pushed through the skull bone when exposed to a sudden accidental impact.

The abutment penetrates the skin and the subcutaneous tissue in order to establish a direct coupling (direct bone conduction) from a hearing aid processor to the skull bone.

Some users with an abutment integrated in the skull experience skin reactions in the area around the abutment. Examples of inflammation or infection are often reported. Likewise, growth of granulation tissue and swelling of the tissue near the abutment can occur. In some case hypertrophy of tissue (including the skin) interferes with the sound processor and the user can be forced to stop using the device.

In difficult cases the problem of hypertrophy or swelling of tissue is solved by revision surgery and in the majority of cases by exchanging the abutment to a longer type in order to avoid contact to the surrounding skin.

Replacement of an abutment often requires the patient to be anaesthetized. Moreover, during abutment exchange there is risk of damage to the internal thread of the external hexagon of the fixture (implant). If the internal thread of the external hexagon of the fixture is damaged, a new surgery procedure is required in order to replace the damaged fixture.

Accordingly, it is desirable to have an alternative to exchanging the abutment in cases in which hypertrophy or swelling of tissue occur.

Therefore, the present disclosure provides an alternative to exchanging the abutment in cases in which swelling of tissue occur.

SUMMARY

The present disclosure can be achieved by a hearing aid interconnection system as defined in claim 1. Preferred embodiments are defined in the dependent claims and explained in the following description and illustrated in the accompanying drawings.

The hearing aid interconnection system according to the disclosure comprises an abutment having a fixture end, and a hearing aid attachment end, where the fixture end is attachable to a bone integrated fixture thereby anchoring the hearing aid interconnection system to a skull bone. The hearing aid attachment end of the abutment comprises hearing aid coupling surfaces adapted for engagement with a hearing aid coupling. The hearing aid interconnection system further comprises an extension member attachable to the abutment at the hearing aid attachment end where the extension member further comprises hearing aid coupling surfaces, whereby the extension member allows an extension of the length (L1) between the fixture and the hearing aid coupling.

By using a hearing aid interconnection system according to the disclosure it is possible to keep using a hearing aid device and an existing abutment in the case of swelling of skin tissue around the abutment.

The abutment may be any suitable type and size of abutment suitable for being used in the hearing aid interconnection system.

The fixture for anchoring the hearing aid interconnection system to a skull bone may be of any suitable type, size and material.

The hearing aid coupling surfaces for attaching a hearing aid device to the abutment or to the extension member may be of any suitable type, size and material. The coupling surfaces may include detachable fastening means, a coupling or any other suitable coupling type.

The extension member may have any suitable form, shape and may be produced in any suitable material as long as the extension member extends the length of the abutment. This ensures an extendable length between the skull bone surface and the underside of the hearing aid device, and temporary or lasting swelling of the skin around the abutment may thus be overcome by using the hearing aid interconnection system with the extension member.

The extension member may be movably mounted to the abutment via the head of a connection screw which passes through a through going hole in the abutment and into the fixture. The connection screw is in place in many such abutments, and may be changed without changing or removing the abutment, thus avoiding a surgical procedure, and thus the use of the screw head as attachment point for the extension may provide some benefit.

Possibly the hearing aid coupling surfaces of the extension member differs from the hearing aid coupling surfaces of the abutment.

This may help in providing an alternative format of the hearing aid fastening means, in case a different format hearing aid is preferred by the user.

The hearing aid coupling surfaces of the extension member may be functionally identical to the coupling surfaces of the abutment, and this is useful in case only an extension of the abutment is desired, and a similar or identical hearing aid is to be coupled to the extension.

According to an embodiment, a tool grip structure may be provided in the extension member. This allows for a torque system to be used, which may not provoke tension in the underlying skull bone.

The extension member may be a one-piece body with the hearing aid coupling surfaces at one part thereof and with abutment connection parts, movably connecting the extension member to the head of connection screw, at another part thereof. The one piece body option is simple and straight forward to mount to the abutment mounting surfaces.

The extension member may comprise a coupling part with hearing aid coupling surfaces and a fixation part movably mounted to the abutment and fixating the coupling part to the abutment via the head of connection screw. By having a coupling part which is separate from the fixation part, enhanced flexibility may be provided, and a range of coupling parts with each their hearing aid coupling surfaces may be provided along with standardized fixation parts.

Preferably a tool grip structure is provided in the movable fixation part of the extension member.

The hearing aid coupling surfaces of the extension member may be arranged for being detachably gripped by gripping jaws belonging to a hearing aid device. This is useful in that the hearing aid may be easily attached or detached from the extension member using whatever gripping jaws it is equipped with.

The hearing aid coupling surfaces of the extension member may alternatively be permanently joined to a hearing aid device output vibration member. In this case the extension member and hearing aid form a non-seperable unit, which is attached to the abutment.

Preferably the extension member has essentially the same width as the top portion of the abutment. And thus the extension member will not cause any un-due obstacle for possible skin thickening.

The extension member may extend along the longitudinal axis of the abutment and may comprise an abutment contact surface which sealingly matches a corresponding contact surface of the top portion of the abutment. It would be apparent to the skilled person that when the extension member of some of the disclosed embodiments is fixated to the abutment, it will not leave any cracks for bacteriologic activity. This may be applicable for at least some of the embodiments described here such as the snap fit extension member with a closed top.

Preferably the extension member extends the abutment with a distance which is at least 1 mm.

In previous embodiments, the extension member is movably mounted to the abutment via a head of a connection screw. However, in an alternative embodiment, the extension member of the hearing aid interconnection system is not mounted on the head of the connection screw. In this embodiment, the extension member includes a fixed part, a movable part and a locking part. The fixed part includes internal threads at an inner surficial periphery of the fixed part, i.e. away from an inner geometry of the abutment. The moveable part includes external threads at a surficial periphery of the moveable part. The internal threads of the fixed part are adapted to interact with external threads of the movable part. The movable part includes a tool grip structure adapted to allow engaging a screwdriver. The fixed part may include another tool grip structure, which is intended for providing counter torque. The locking part is adapted to lock the abutment extension with the abutment such that in a locked position of the extension member with the abutment, the abutment is extended by thickness of the fixed part along the longitudinal axis of the abutment. A number of locking mechanisms using different types of locking part adapted to work with this embodiment are within scope of this disclosure.

According to an embodiment, the hearing aid interconnection system includes a snap fit extension member. The snap fit extension member includes a hearing aid coupling surface adapted for engagement with a hearing aid coupling. The snap fit extension member further includes a side section that is adapted to snap couple with the hearing aid attachment end of the abutment. The side section is made of a flexible material that is adapted to extend or retract under force and after passing around or within a section of the hearing aid attachment end, retains or substantially retains its original shape in order to couple with the hearing aid attachment end. In one embodiment, the side section is positioned over the hearing aid attachment end. On application of a force on the snap fit extension member, the side section temporarily extends outwards and couples with the hearing aid coupling surface of the abutment by snap coupling around a periphery of the hearing aid attachment end, i.e. the hearing aid attachment end behaves like a male part and the side section behaves like a female part of the coupling relationship. Alternatively in another embodiment, the side section is positioned over the hearing aid coupling surface of the abutment. On application of a force on the snap fit extension member, the side section temporarily retracts inwards and couples with the hearing aid attachment end by snap coupling within the hearing aid attachment end, i.e. the hearing aid coupling surface of the abutment behaves like a female part and the side section behaves like a male part in the coupling relationship.

The snap fit extension member may have a hollow top or a closed top. The hollow version may be useful as it allows an access to the connection screw. The closed version, apart from avoiding bacteriologic activity as mentioned earlier, may be useful as comparatively, this version would be easier to clean.

In either embodiment, the male portion may include rounded edges to facilitate the snap-couple into the female portion. Additionally or alternatively, the female portion may include rounded edges to facilitate the snap-couple of the male portion into the female portion. The relative dimension of the attachment end and the side section for each of these embodiments would be apparent for a person skilled in the art.

DESCRIPTION OF THE DRAWINGS

The disclosure will become more fully understood from the detailed description given herein below. The accompanying drawings are given by way of illustration only, and thus, they are not limitative of the present disclosure. In the accompanying drawings:

FIG. 1 B) shows a front view of the hearing aid connection system shown in FIG. 1 A) according to an embodiment;

FIG. 2 B) shows a schematic cross-sectional view of the hearing aid connection system shown in FIG. 2 A) according to an embodiment;

FIG. 3 B) shows a schematic view of a prior art bone anchored hearing aid system similar to the one shown in FIG. 3 A), where the hearing aid abutment is surrounded by swollen skin tissue;

FIG. 4 B) shows a schematic view of an extension member mounted on a bone anchored hearing aid abutment surrounded by swollen skin tissue according to an embodiment;

FIG. 4 C) shows a schematic view of a hearing aid device attached to the bone anchored hearing aid abutment shown in FIG. 4 B) according to an embodiment;

FIG. 5 B) shows a schematic view of an extension member mounted on a bone anchored hearing aid abutment is surrounded by swollen skin tissue according to an embodiment;

FIG. 5 C) shows a hearing aid device attached to the bone anchored hearing aid system shown in FIG. 4 B) according to an embodiment;

FIG. 6 B) shows a schematic view of an extension member mounted on a bone anchored hearing aid abutment is surrounded by swollen skin tissue according to an embodiment;

FIG. 7 B) shows the extension member of FIG. 8 A) attached to an abutment according to an embodiment;

FIG. 8 B) shows an extension member with closed top according to another embodiment.

DETAILED DESCRIPTION

Figure 1B:
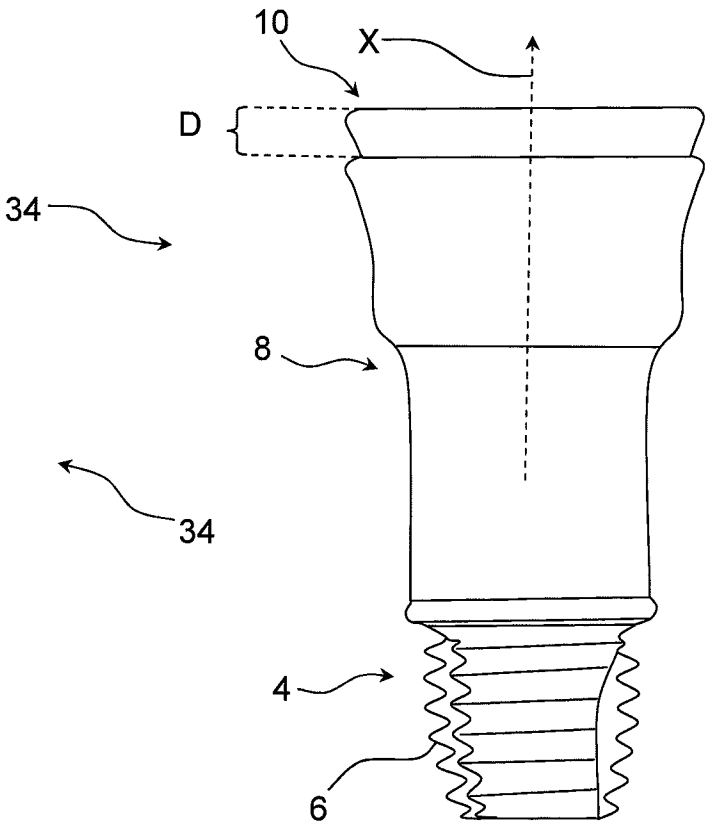
FIG. 1 A) shows a schematic cross-sectional view of a hearing aid connection system according to embodiment.
Figure 1A:
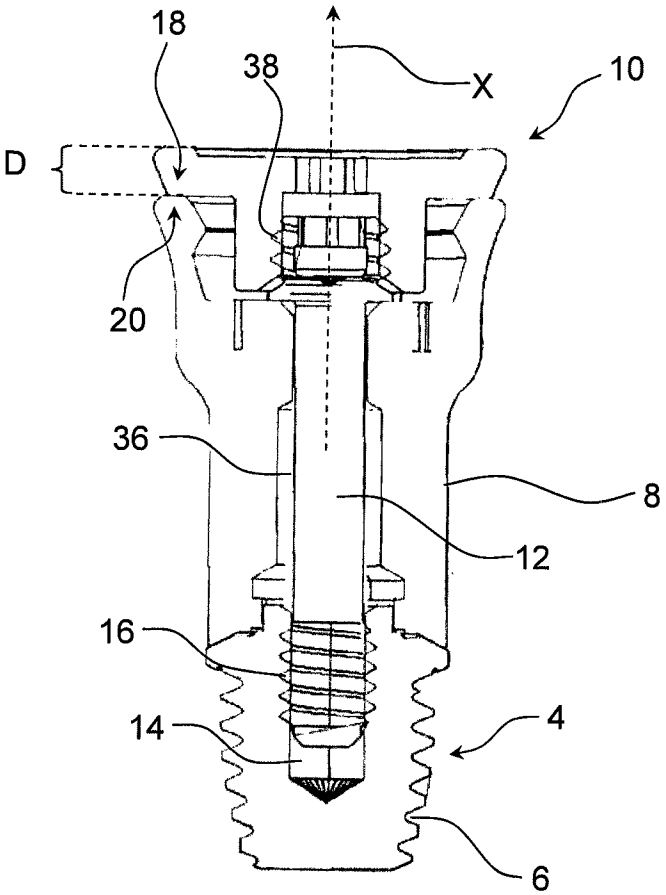

Referring now in detail to the drawings for the purpose of illustrating preferred embodiments of the present disclosure, different views of a hearing aid interconnection system 34 according to the disclosure are illustrated in FIG. 1.

FIG. 1 A) shows a schematic cross-sectional view of a hearing aid interconnection system 34 aid according to an embodiment.

The hearing aid interconnection system 34 comprises a fixture 4 having a threaded portion 6. The fixture 4 is configured to be anchored and implanted in the skull bone of a user of a hearing aid.

The hearing aid interconnection system 34 comprises an abutment 8 adapted to penetrate the skin and interconnect a hearing aid to the skull bone via the implanted fixture 4. The abutment 8 comprises a through-going hole 36 configured to receive a connection screw 12 that is used to mechanically fix the fixture 4 and the abutment 8 to each other.

The fixture 4 comprises a bore 14 having inner threads configured to receive the threaded portion 16 of the connection screw 12.

By tightening the connection screw 12, the screw 12 is displaced along the longitudinal axis X of the abutment 8. Hereby it is possible to secure that the fixture 4 and the abutment 8 are firmly attached to each other.

By the above measures the abutment will be fixed to the fixture at a fixture end thereof, and at an opposed end a hearing aid attachment end is sitting above the skin surface, and a hearing aid may be attached at surfaces thereof, which are adapted to receive the hearing aid.

The hearing aid interconnection system 34 comprises an extension member 10 which when mounted provides an extension of the abutment 8 along the longitudinal axis X thereof. The extension member 10 comprises a contact surface 18 matching a corresponding contact surface 20 of the top portion of the abutment 8.

The extension member 10 is screwed onto the top portion of the connection screw 12. The extension member 10 comprises a threaded bore that is adapted to receive the threaded top portion 38 of the connection screw 12. Thus the extension member 10 is detachably attached to the abutment 8. The extension member 10 is intended to add a certain length to the abutment 8. This may be a useful alternative to exchanging the abutment 8 in case of swollen skin tissue. It can be seen that the extension member 10 add a length to the abutment 8 of a distance D.

FIG. 1 B) illustrates a front view of the hearing aid connection system 34 shown in FIG. 1 A). The hearing aid connection system 34 comprises a fixture 4 that is attached to the distal end of an abutment 8. The abutment 8 is sandwiched between the fixture 4 and an extension member 10 fixed to the proximal end of the abutment 8. The extension member 10 adds a length of distance D to the abutment 8 as indicated at FIG. 1 B).

The fixture 4 comprises a threaded portion 6 that is adapted to be anchored into the skull bone of a user of a hearing aid.

It can be seen that the abutment 8 as well as the extension member 10 are symmetric about the longitudinal axis X of the abutment 8. The extension member 10 is a one piece part with hearing aid coupling surfaces at one part thereof and with abutment connection parts, movably connecting the extension member 10 to the head of connection screw 12, at another part thereof.

Figure 2B:
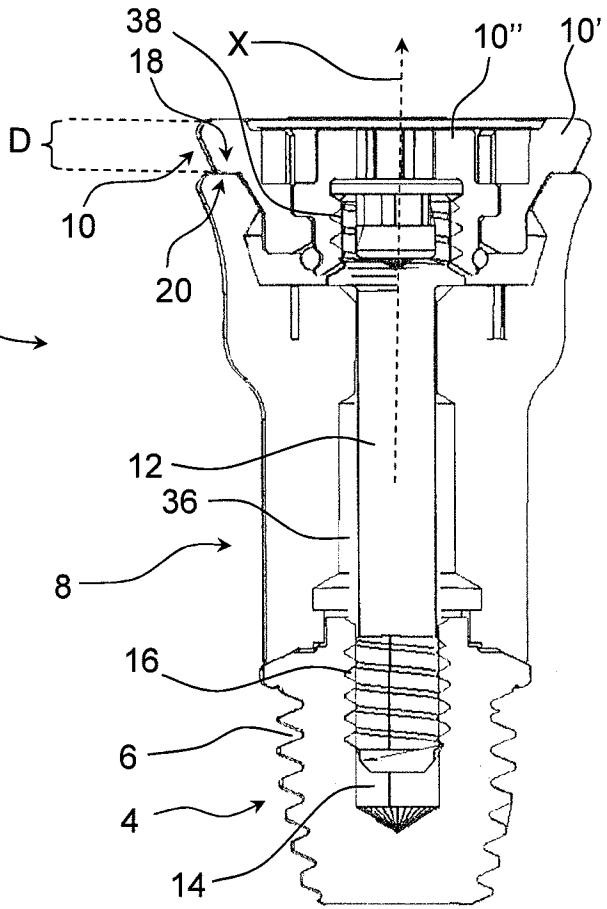
FIG. 2 A) shows a schematic perspective view of a hearing aid connection system according to an embodiment.
Figure 2A:
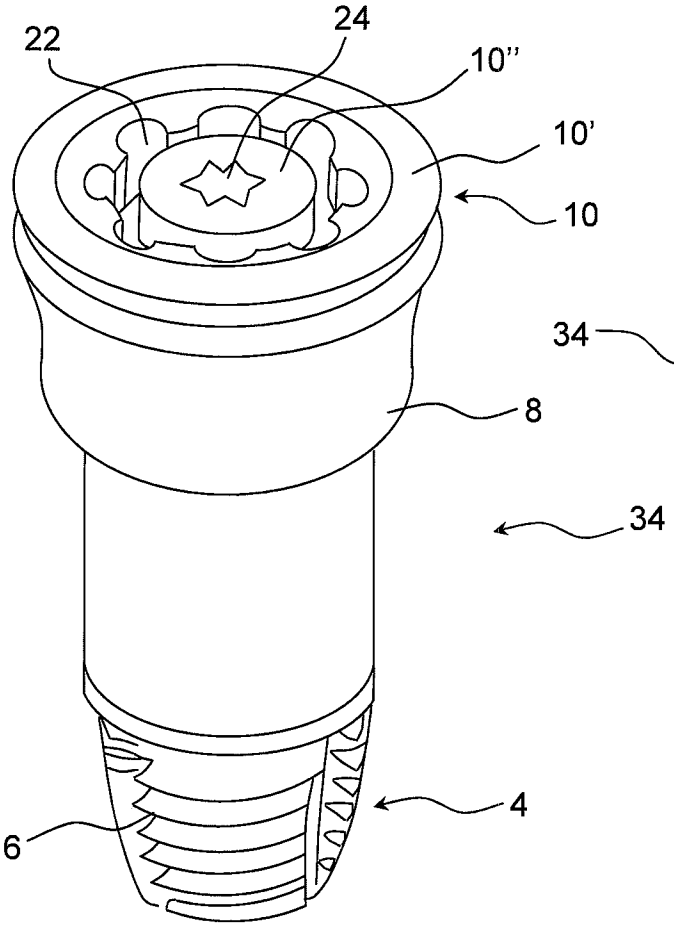

FIG. 2 A) illustrates a schematic perspective view of a hearing aid connection system 34 according to an embodiment. The hearing aid connection system 34 comprises a fixture 4 having a threaded portion 6 configured to be anchored into the skull bone of a user of a hearing aid. An abutment 8 is mechanically attached to the fixture 4 and an extension member 10 is fixed to the proximal end of the abutment 8.

The extension member 10 comprises a fixed part 10' constituting the periphery of the extension member 10. The extension member 10 moreover comprises a movable part 10" that is movably mounted to the abutment 8 via a connection screw 12 (see FIG. 2 B).

A tool grip structure 24 adapted for engagement of a screwdriver is provided in the movable part 10" of the extension member 10. Another tool grip structure 22 is provided in the fixed part 10' of the extension member 10. The grip structure 22 is intended for providing counter torque.

FIG. 2 B) illustrates a schematic cross-sectional view of the hearing aid connection system 34 shown in FIG. 2 A). The hearing aid connection system 34 comprises a fixture 4 having a threaded portion 6 for anchoring the fixture 4 in the skull bone of a user of a hearing aid.

The hearing aid connection system 34 moreover comprises an abutment 8 that is mechanically attached to the fixture 4 by means of a centrally arranged connection screw 12. The connection screw is screwed into a centrally arranged threaded bore 14 provided in proximal and central end of the fixture 4. The connection screw 14 comprises a threaded portion 16 configured to engage in the threaded bore 14 in the fixture 4.

The abutment 8 comprises a through-going hole 36 configured to receive the connection screw 12 that is used to mechanically attach the fixture 4 to the abutment 8.

The extension member 10 comprises a fixed part 10' and a movable part 10" movably mounted to the abutment 8 via the connection screw. The movable part 10" comprises a threaded bore that is adapted to receive the threaded top portion 38 of the connection screw 12.

A contact surface 20 provided at the proximal end of the abutment 8 bears against a corresponding contact surface 18 of the fixed part 10' of the extension member 10.

Figure 3B:
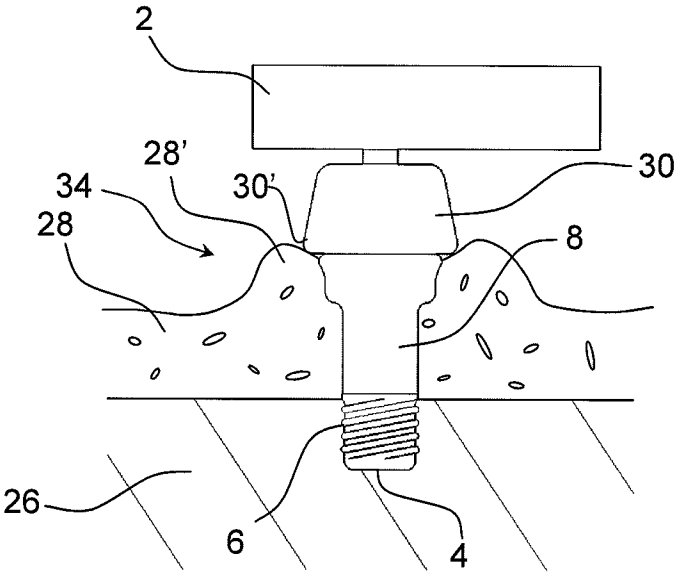
Prior Art Fig. 3B
FIG. 3 A) shows a schematic view of a prior art bone anchored hearing aid system including a hearing aid that is connected to a hearing aid abutment that penetrates the skin and is connected to a fixture anchored in the skull bone.
Figure 3A:
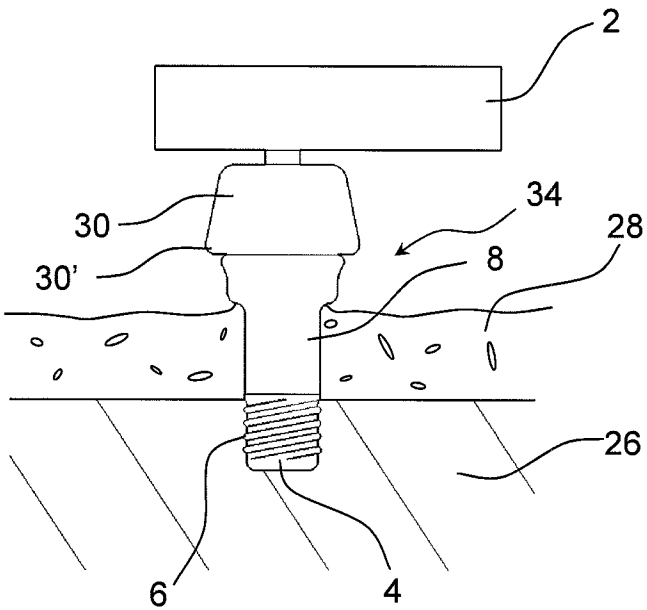
Prior Art Fig. 3A

FIG. 3 A) illustrates a schematic view of a prior art bone anchored hearing aid system 34. The prior art bone anchored hearing aid system 34 is connected to a hearing aid abutment 8 that penetrates the skin 28 of the user of a hearing aid device 2. The hearing aid abutment 8 is connected to a fixture 4 that is anchored in the skull bone 26 of the user by means of a threaded portion 6.

The hearing aid device 2 is mechanically attached to a coupling 30 that may comprise gripping jaws 30' which are adapted for a mechanical attachment to the abutment 8. Various jaw formats are available at the market, and they are not shown in further detail here.

FIG. 3 B) illustrates a schematic view of the bone anchored hearing aid system 34 shown in FIG. 3 A). The bone anchored hearing aid system 34 comprises a hearing aid abutment 8 that is surrounded by skin tissue 28' which has swollen due to hypotrophy or other disorder. A tissue growth like the one illustrated in FIG. 3 B) typically may occur as a consequence of inflammation or infection in the skin tissue surrounding the abutment 8.

Swollen scars 28' like the swollen skin tissue 28' indicated in FIG. 3 B) occur when the body overproduces collagen, which causes the scar 28' to be raised above the surrounding skin 28.

Figures 4A, 4B, 4C:
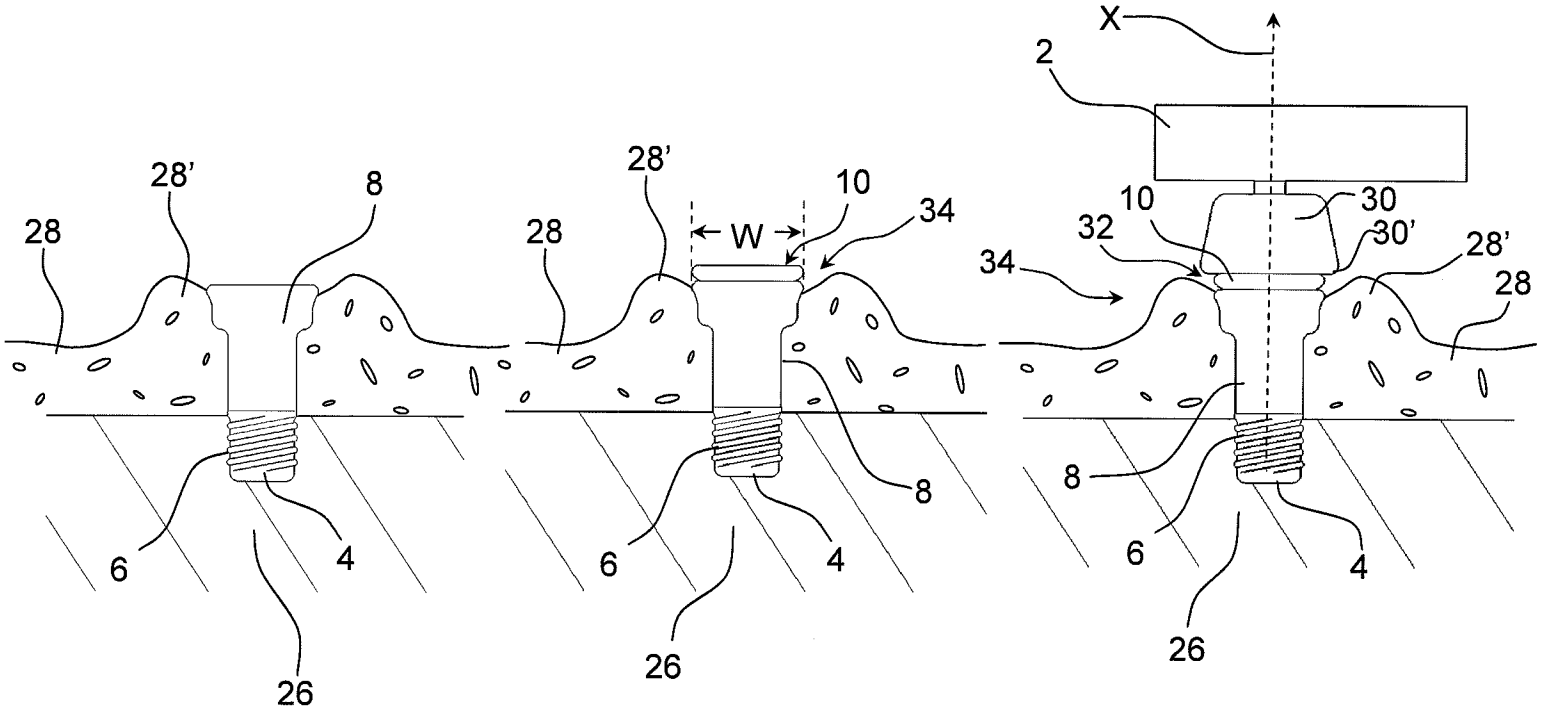
FIG. 4 A) shows a schematic view of a bone anchored hearing aid abutment surrounded by swollen skin tissue according to an embodiment.

The swollen skin tissue 28' has risen to such a level above the surrounding skin 28 that the skin tissue 28' interferes with the coupling 30 and the sound processor (not shown) in the hearing aid device 2. Accordingly, the abutment 8 needs to be exchanged in order to make the hearing aid device 2 work properly. FIG. 4 A) illustrates a schematic view of a bone anchored hearing aid abutment 8 surrounded by swollen skin tissue 28'. The skin tissue 28' is approximately twice as thick as the remaining portion of the skin 28.

The abutment 8 is mechanically attached to an anchored fixture 4 provided with a threaded portion 6. The fixture 4 is anchored into the skull bone 26 of a user of a hearing aid.

FIG. 4 B) illustrates a schematic view of a thin extension member 10 according to an embodiment mounted on the bone anchored hearing aid abutment 8 shown in FIG. 4 A). The extension member 10 has the same width, W, as the proximal portion of the abutment 8.

FIG. 4 C) illustrates a schematic view of a hearing aid device 2 mechanically attached to the bone anchored hearing aid abutment 8 shown in FIG. 4 B) via a coupling 30. The coupling 30 is attached to the extension member 10 that is mechanically attached to the abutment 8. The abutment 8 is fixed to the anchored fixture 4 provided with a threaded portion 6. The fixture 4 is anchored into the skull bone 26.

When the extension member 10 is attached to the abutment 8, the coupling 30 and thus the hearing aid device 2 is displaced along the longitudinal axis X of the abutment 8. Thus, a gap 32 is provided between the skin tissue 28' and the coupling 30.

Figures 5A, 5B, 5C:
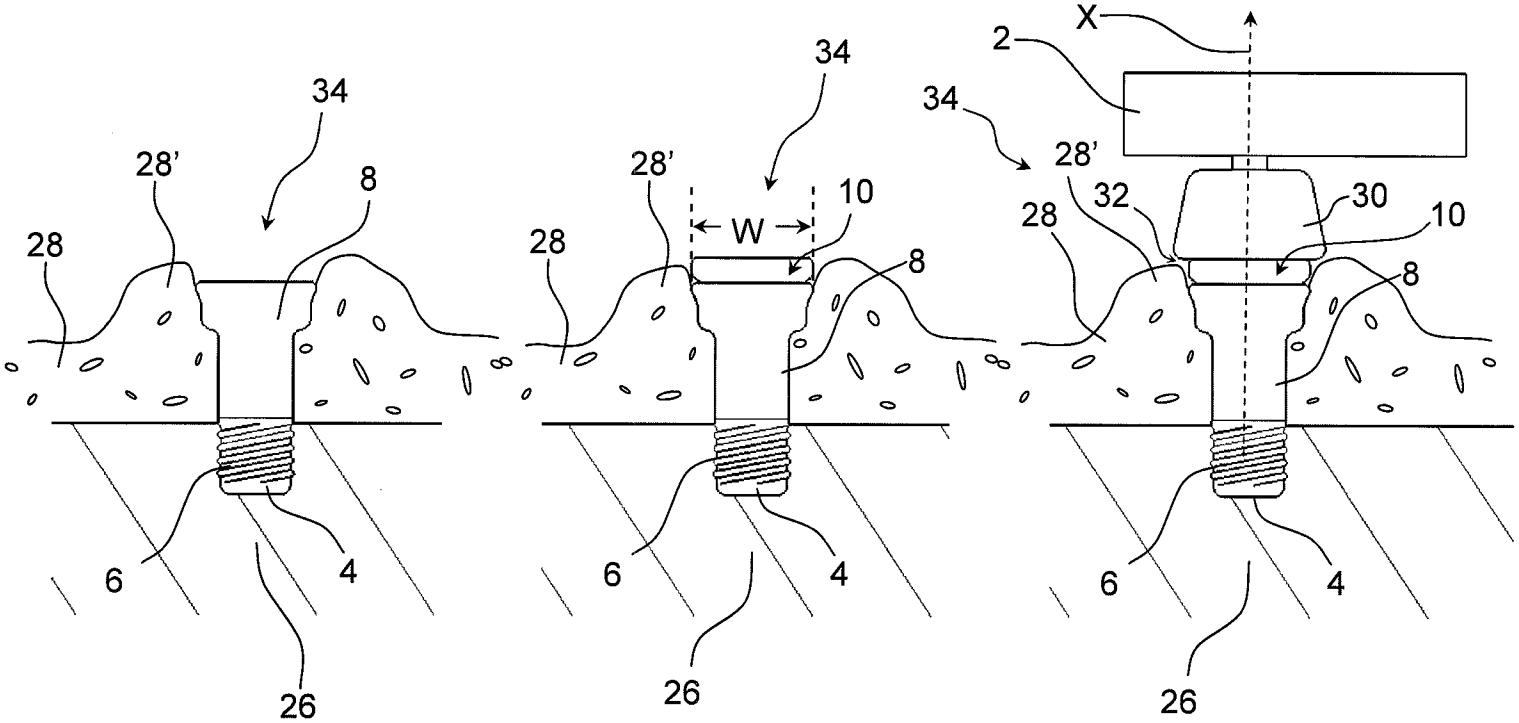
FIG. 5 A) shows a schematic view of a bone anchored hearing aid abutment is surrounded by swollen skin tissue according to an embodiment.

Hereby, the swollen or swollen skin tissue 28' will not interfere with the coupling 30 or the processor in the hearing aid device 2. Accordingly, the extension member 10 makes it possible to keep applying the hearing aid device 2 and the existing abutment 8 despite the existence of the skin tissue 28'. FIG. 5 A) illustrates a schematic view of a bone anchored hearing aid abutment 8 surrounded by a swollen or swollen skin tissue 28'. The swollen skin tissue 28' in FIG. 5 is thicker than the swollen skin tissue 28' shown in FIG. 4.

The abutment 8 is mechanically attached to an anchored fixture 4 provided with a threaded portion 6. The fixture 4 is anchored into the skull bone 26 of a user of a hearing aid.

FIG. 5 B) illustrates a schematic view of a thick extension member 10 according to an embodiment. The extension member 10 is mounted on the bone anchored hearing aid abutment 8 shown in FIG. 5 A). The extension member 10 has the same width, W, as the proximal portion of the abutment 8.

FIG. 5 C) illustrates a schematic view of a hearing aid device 2 that is mechanically fixed to the abutment 8 shown in FIG. 5 B) via a coupling 30. The coupling 30 is fixed to the extension member 10. The extension member 10 is mechanically attached to the abutment 8. The abutment 8 is fixed to the anchored fixture 4 provided with a threaded portion 6 and is anchored into the skull bone 26.

Attaching the extension member 10 to the abutment 8 causes a displacement of the coupling 30. Thus, the hearing aid device 2 is moved along the longitudinal axis X of the abutment 8 and a gap 32 is established between the thickened skin tissue 28' and the coupling 30.

Therefore, the thickened skin tissue 28' will not interfere with the coupling 30 or the processor in the hearing aid device 2.

By using an extension member 10 according to an embodiment it is possible to keep applying the hearing aid device 2 and the existing abutment 8 despite the existence of thickened or swollen skin tissue 28'.

The thickness of the extension member 10 may depend on the specific requirements. The thickness of the extension member 10 may by 1 mm or more, e.g. 2 mm by way of example.

Figure 6B:
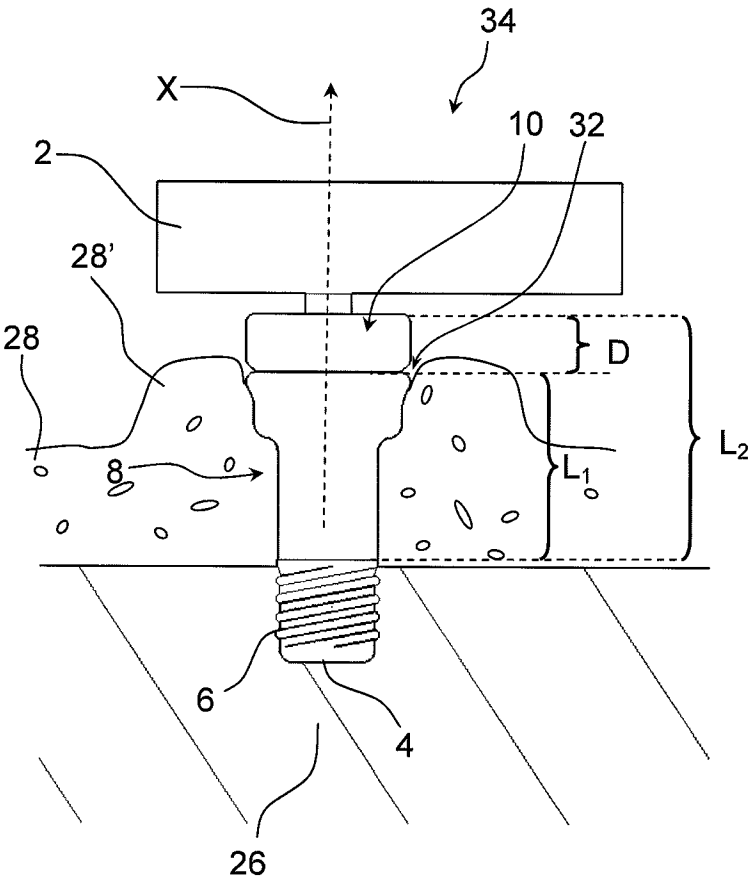
FIG. 6 A) shows a schematic view of a hearing aid interconnection system comprising a prior art bone anchored hearing aid abutment is surrounded by swollen skin tissue.
Figure 6A:
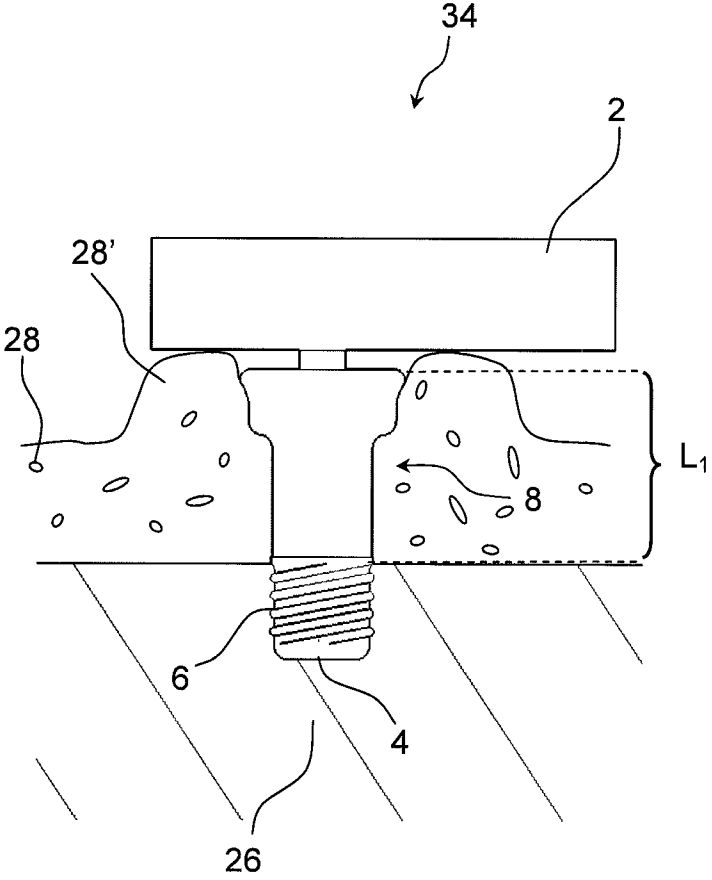
Prior Art Fig. 6A

FIG. 6 A) illustrates a schematic view of a hearing aid interconnection system 34 comprising a prior art bone anchored hearing aid abutment 8 surrounded by swollen skin tissue 28'. The thickness of the thickened skin tissue 28' exceeds the thickness of the remaining skin 28. The thickness of the thickened skin tissue 28' also exceeds the length $L_1$ of the abutment 8.

The abutment 8 is attached to a fixture 4 provided with threads 6 and anchored to the skull bone 26 of a user of a hearing aid.

The swollen or thickened skin tissue 28' surrounding the abutment 8 is in physical contact with the hearing aid device 2. Thus, there is a risk that the hearing aid device 2 will not function properly due to the presence of the swollen skin tissue 28'.

In such a case the abutment 8 would be exchanged with a larger one. Replacement of an abutment 8 may require anaesthetic treatment and may introduce risk of damaging the internal thread of the external hexagon of the fixture 4. If the internal thread of the external hexagon of the fixture 4 is damaged a new surgery procedure is required in order to replace the damaged fixture 4.

FIG. 6 B) illustrates a schematic view of a hearing aid interconnection system 34 comprising an extension member 10 according to an embodiment. The extension member 10 is mounted on a bone anchored hearing aid abutment 8 that is surrounded by thickened skin tissue 28' corresponding to the one shown in FIG. 6 A).

The extension member 10 is mechanically attached to the abutment 8 and the abutment 8 is fixed to an anchored fixture 4 provided with a threaded portion 6 and is anchored into the skull bone 26.

When the extension member 10 is attached to the abutment 8 the coupling 30 is displaced a distance, D, along the longitudinal axis X of the abutment 8. Thus, a gap 32 is established between the thickened skin tissue 28' and the hearing aid device 2. The length of the abutment 8 and the attached extension member 10 is $L_2$, while the length of the abutment 8 is $L_1$. It can be seen that the difference between the length, $L_2$, of the abutment 8 with the attached extension member 10 and the length, $L_1$, of the abutment 8 is given by:

$$L_2-L_1=D, \quad (1)$$

where D is the distance that the extension member 10 adds to the length of the abutment 8 along the longitudinal axis X of the abutment 8.

Therefore, the thickened skin tissue 28' will not interfere with the hearing aid device 2.

By using an extension member 10 according to an embodiment it is possible to keep using the hearing aid device 2 and the existing abutment 8 despite the existence of thickened skin tissue 28'.

The thickness of the extension member 10 may depend on the specific requirements. The thickness of the extension member 10 may by 1 mm or more, e.g. 2 mm by way of example so that the distance D that the extension member 10 extends the abutment 8 along the longitudinal axis X of the abutment 8 is 1 mm or more.

Figure 7B:
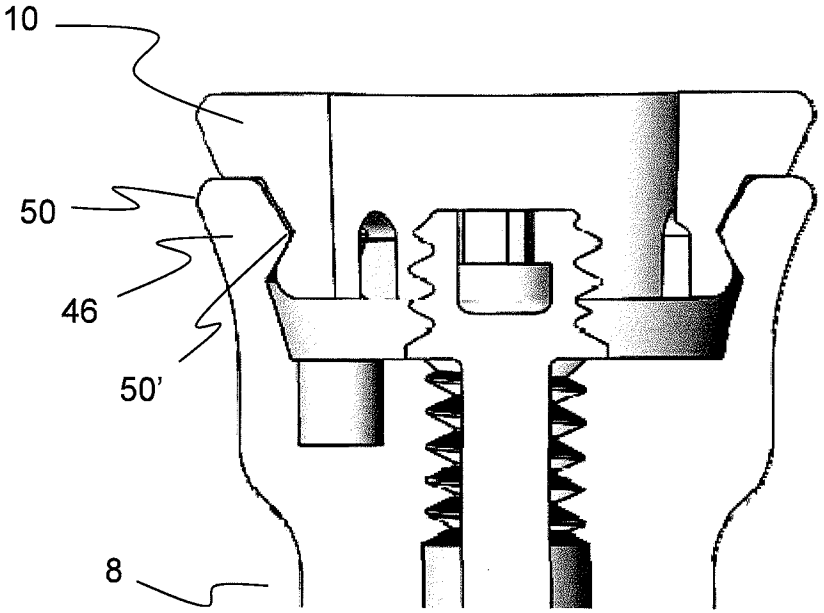
FIG. 7 A) shows an extension member according to an embodiment.
Figure 7A:
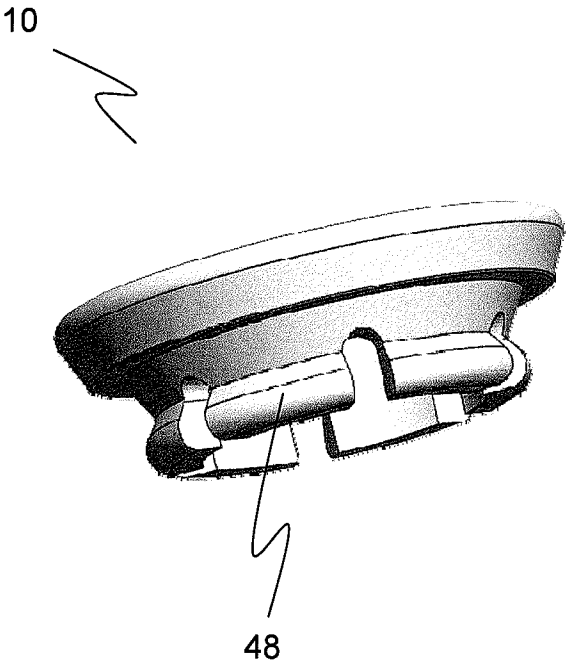

FIG. 7 A) shows an extension member and FIG. 7 B) shows the extension member attached to an abutment 8 according to an embodiment. The hearing aid interconnection system includes a snap fit extension member 10. The snap fit extension member 10 includes a hearing aid coupling surface adapted for engagement with a hearing aid coupling. The snap fit extension member further includes a side section 48 that is adapted to snap couple with the hearing aid attachment end 46. The side section 48 is made of a flexible material that is adapted to extend or retract under force and after passing around 50 or within 50' a section of the hearing aid attachment end, retains or substantially retains its original shape in order to couple with the hearing aid attachment end. In one embodiment, the side section is positioned over the hearing aid attachment end. The FIG. 7 B) illustrates the extension member 10 being snap coupled within 50' the hearing aid attachment end 46. However, in alternative embodiment, the extension member may be snap coupled around 50 the hearing aid attachment end 46. The embodiment may include rounded edges at either or both interacting edges of the extension member 10 and/or hearing aid attachment end to facilitate snap locking step. For example, the FIG. 7 B) shows rounded edge at lower external periphery of the extension member 10.

Figure 8B:
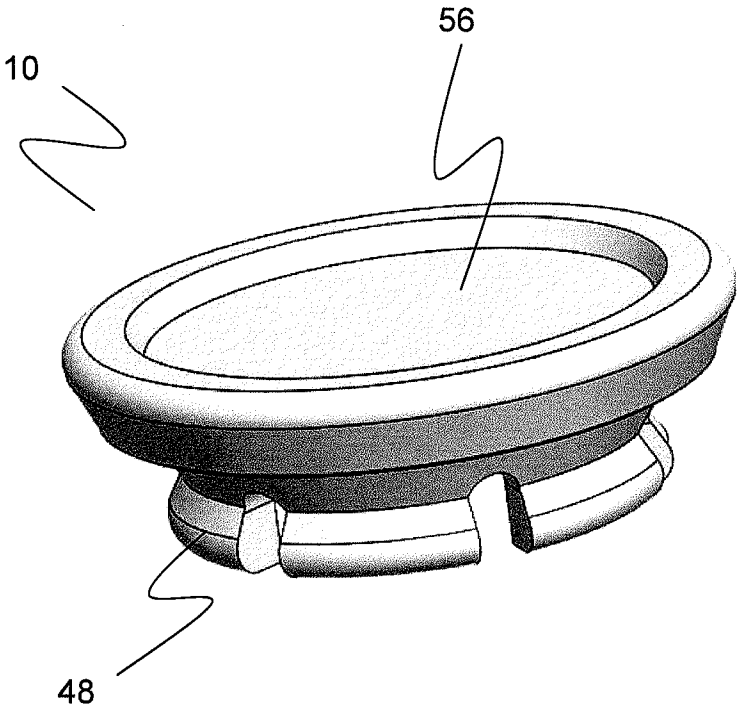
FIG. 8 A) shows an extension member with hollow top according to an embodiment.
Figure 8A:
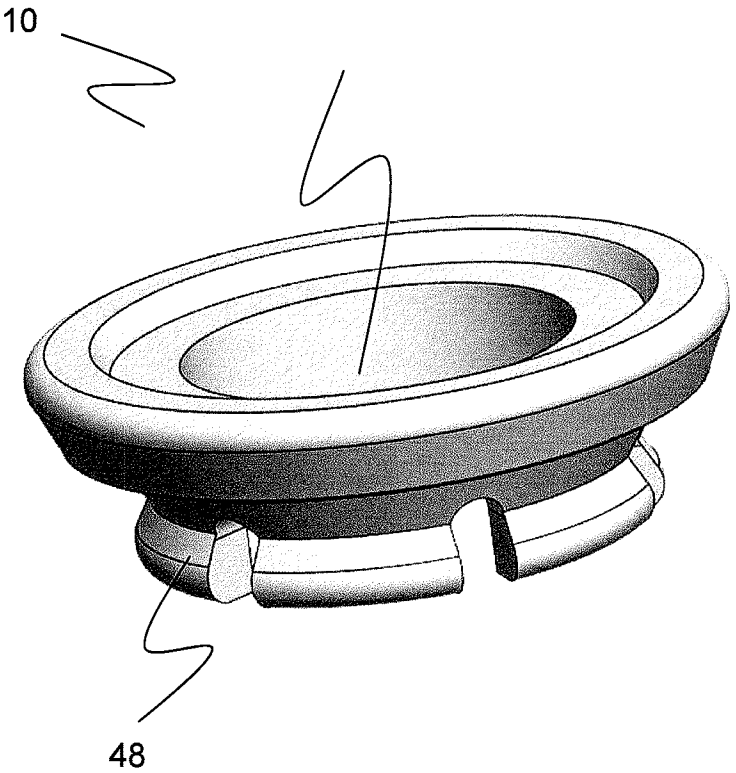

FIG. 8 A) shows an extension member 10 with hollow top 54 according to an embodiment. Alternatively, in another embodiment, FIG. 8 B) shows an extension member 10 with closed top 56.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "some embodiments" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid system comprising an abutment configured to mechanically attach into a skull bone of a hearing aid user;

an extension member configured to attach to the abutment and further comprising a hearing aid coupling surface adapted to attach with a hearing aid device;

the hearing aid device comprising a coupling adapted to mechanically attach to the hearing aid coupling surface, wherein the extension member is configured to attach between the abutment and the coupling and to extend length between the abutment and the hearing aid coupling.

2. The hearing aid system according to claim 1, wherein the hearing aid system is a bone anchored hearing aid system; and the hearing aid device comprises a sound processor.

3. The hearing aid system according to claim 1, wherein the abutment comprises a fixture end configured to attach to a bone integrated fixture comprising a threaded portion, the fixture being anchored into the skull bone using the threaded portion thereby providing mechanical attachment of the abutment into the skull bone of a hearing aid user.

4. The hearing aid system according to claim 1, wherein extending length between the abutment and the hearing aid coupling is along a longitudinal axis X of the abutment.

5. The hearing aid system according to claim 1, wherein the extension member is a snap fit extension member comprising a side section configured to snap couple with the hearing aid attachment end of the abutment.

6. The hearing aid system according to claim 5, wherein the side section is configured to extend or retract under force and after passing around or within a section of the hearing aid attachment end, retains or substantially retains original shape in order to couple the extension member with the hearing aid attachment end.

7. The hearing aid system according to claim 1, wherein the extension member is movably mounted to the abutment via a head of a connection screw which passes through a through going hole in the abutment and into the fixture.

8. The hearing aid system according to claim 1, wherein the extension member comprises a tool grip structure.

9. The hearing aid system according to claim 8, wherein the extension member is a one-piece body comprising the hearing aid coupling surface at one part thereof and with abutment connection parts, movably connecting the extension member to the head of connection screw, at another part thereof.

10. The hearing aid system according claim 7, wherein the extension member comprises a coupling part with hearing aid coupling surface and a fixation part movably mounted to the abutment and fixating the coupling part to the abutment via the head of connection screw.

11. The hearing aid system according to claim 1, wherein the hearing aid device comprises gripping jaws configured to detachably grip the hearing aid coupling surface of the extension member.

12. The hearing aid system according to claim 1, wherein the extension member extends along the longitudinal axis of the abutment and that the extension member comprises an abutment contact surface configured to sealingly match a corresponding contact surface of the top portion of the abutment.

13. The hearing aid system according to claim 1, wherein the extension member extends the abutment with a distance which is at least 1 mm.

14. The hearing aid system according to claim 1, wherein the hearing aid coupling surfaces of the extension member are permanently joined to a hearing aid device output vibration member.

15. The hearing aid according to claim 1, wherein the extension member comprises an open top or a closed top.

* * * * *